US011091929B2

(12) United States Patent
Taylor et al.

(10) Patent No.: US 11,091,929 B2
(45) Date of Patent: Aug. 17, 2021

(54) METHOD FOR PRODUCING REGISHELL INFLATABLE ENVIRONMENT

(71) Applicant: The Aerospace Corporation, El Segundo, CA (US)

(72) Inventors: Allison B. Taylor, Leesburg, VA (US); Henry Helvajian, Pasadena, CA (US); Randy M. Villahermosa, La Canada, CA (US); Lael F. Woods, Merritt Island, FL (US)

(73) Assignee: THE AEROSPACE CORPORATION, El Segundo, CA (US)

( * ) Notice: Subject to any disclaimer, the term of this patent is extended or adjusted under 35 U.S.C. 154(b) by 0 days.

(21) Appl. No.: 16/656,503

(22) Filed: Oct. 17, 2019

(65) Prior Publication Data

US 2021/0115693 A1 Apr. 22, 2021

(51) Int. Cl.
*B05D 7/22* (2006.01)
*B05D 1/02* (2006.01)
(Continued)

(52) U.S. Cl.
CPC ..... *E04H 15/20* (2013.01); *E04B 1/3211* (2013.01); *E04B 1/34* (2013.01); *E04B 1/92* (2013.01);
(Continued)

(58) Field of Classification Search
CPC ..... E04H 15/20; E04H 2015/202; E04B 1/34; E04B 1/3211; E04B 1/92; B05D 1/02;
(Continued)

(56) References Cited

U.S. PATENT DOCUMENTS 4,730,797 A 3/1988 Minovitch
4,964,597 A * 10/1990 Hijazi ..... B64G 1/12 244/159.4
(Continued)

FOREIGN PATENT DOCUMENTS

AT 516623 A4 * 7/2016
AT 521909 A1 * 6/2020 ..... B64G 1/12
(Continued)

OTHER PUBLICATIONS

Hintze, P. E., "Building a Vertical Take Off and Landing Pad Using in situ Materials," Space Manufacturing 14: Critical Technologies for Space Settlement—Space Studies Institute Oct. 29-31, 2010 (Year: 2010).*
(Continued)

*Primary Examiner* — William P Fletcher, III
(74) *Attorney, Agent, or Firm* — LeonardPatel PC

(57) ABSTRACT

A method for constructing an inflatable environment on top of or beneath a surface of an extraterrestrial object includes spraying Regishell onto an airform or piping the Regishell into a sandwich membrane layer of the airform. When performing the spraying of the Regishell, the method further includes combining basalt material with the Regishell and applying the combination of the basalt material and Regishell to a reinforcement layer, the reinforcement layer being internal to the airform to strengthen the inflatable environment. When performing the piping of the Regishell into the sandwich membrane, the method further includes using the sandwich membrane layer as a permeable membrane or drilling one or more holes in the sandwich membrane layer forming vents to create the permeable membrane, and releasing the gas from the sandwich membrane layer from the vents to cure and conform the Regishell as a rigid shape and structurally sound layer.

5 Claims, 6 Drawing Sheets

(51) Int. Cl.

| | |
|---|---|
| ***E04H 15/20*** | (2006.01) |
| ***E04B 1/34*** | (2006.01) |
| ***E04B 1/32*** | (2006.01) |
| ***E04B 1/92*** | (2006.01) |

(52) U.S. Cl.
CPC ..... *B05D 1/02* (2013.01); *B05D 7/22* (2013.01); *B05D 2259/00* (2013.01); *B05D 2401/10* (2013.01); *B05D 2503/00* (2013.01); *B05D 2518/00* (2013.01); *E04H 2015/202* (2013.01)

(58) Field of Classification Search
CPC ..... B05D 2503/00; B05D 2259/00; B05D 2518/00; B05D 2401/10; B05D 7/22; C04B 18/18; C04B 18/20; C04B 22/00; C04B 24/001; C04B 24/2676; C04B 24/282; C04B 41/45; C04B 41/4505; C04B 2111/00482; C04B 2111/00586; C04B 2111/00732
See application file for complete search history.

(56) References Cited

U.S. PATENT DOCUMENTS

| | | | | |
|---|---|---|---|---|
| 5,058,330 | A * | 10/1991 | Chow | E04H 15/22 52/2.11 |
| 5,094,409 | A | 3/1992 | King et al. | |
| 5,429,851 | A | 7/1995 | Sallee | |
| 6,547,189 | B1 * | 4/2003 | Raboin | B64G 1/12 244/158.3 |
| 7,703,721 | B2 | 4/2010 | Bigelow | |
| 7,735,265 | B2 | 6/2010 | Tinker et al. | |
| 8,186,625 | B2 | 5/2012 | Jong | |
| 8,366,052 | B1 | 2/2013 | Lutke et al. | |
| 8,931,739 | B1 | 1/2015 | Lutke et al. | |
| 9,133,280 | B2 | 9/2015 | Evans et al. | |
| 9,140,023 | B2 | 9/2015 | McCaffrey | |
| 9,166,811 | B2 | 10/2015 | Lawyer et al. | |
| 9,415,575 | B2 | 8/2016 | Beiermann et al. | |
| 9,581,021 | B2 | 2/2017 | Ethridge | |
| 9,771,462 | B2 | 9/2017 | Evans et al. | |
| 9,988,138 | B2 | 6/2018 | Lutke et al. | |
| 2011/0180669 | A1 * | 7/2011 | Johnson | B64G 9/00 244/158.3 |
| 2011/0303254 | A1 | 12/2011 | Tucker et al. | |

FOREIGN PATENT DOCUMENTS

| | | | | |
|---|---|---|---|---|
| CN | 103342168 | A * | 10/2013 | |
| RU | 85524 | U1 * | 8/2009 | |
| RU | 2718548 | C1 * | 4/2020 | E04B 1/3211 |
| WO | WO-2020172654 | A1 * | 8/2020 | |

OTHER PUBLICATIONS

Raju, P. M.; Pranathi, S. In Proceedings of AARCV 2012; Bonfring: Bangalore, 2012. (Year: 2012).*

Montes et al., "Evaluation of lunar regolith geopolymer binder as a radioactive shielding material for space exploration applications," Advances in Space Research 56 (2015) 1212-1221. (Year: 2015).*

Mcclain, J. Making bricks from regolith (because there's no Home Depot on Mars). https://phys.org/news/2016-06-bricks-regolith-home-depot-mars.html (accessed Sep. 29, 2020). (Year: 2016).*

Jakus, A. E.; Koube, K. D.; Geisendorfer, N. R.; Shah, R. N. Robust and Elastic Lunar and Martian Structures from 3D-Printed Regolith Inks. Scientific Reports 2017, 7 (1). (Year: 2017).*

Sargent, Sara, "Radiation Shielding Bricks for Mars Using Martian Regolith Simulant and Hydrogen-Rich Polymers" (2018). Dissertations, Theses, and Masters Projects. Paper 1550153774. http://dx.doi.org/10.21220/s2-acwh-k853 (Year: 2018).*

Hydrogenous Polymer-Regolith Composites for Radiation-Shielding Materials, Phase II. https://techport.nasa.gov/view/90198 (accessed Sep. 29, 2020). (Year: 2018).*

Meurisse et al., "Solar 3D printing of lunar regolith," Acta Astronautica 152 (2018) 800-810. (Year: 2018).*

Arnhof, M.; Pilehvar, S.; Kjoniksen, A.-L.; Cheibas, I. In 8th European Conference for Aeronautics and Space Sciences (EUCASS); Madrid, 2019. (Year: 2019).*

Nardi, T. Off-World Cement Tested For The First Time. https://hackaday.com/2019/09/30/off-world-cement-tested-for-the-first-time/ (accessed Sep. 29, 2020). (Year: 2019).*

Su, H., Hong, Y., Chen, T., Kou, R., Wang, M., Zhong, Y., Qiao. Fatigue Behavior of Inorganic-Organic Hybird "Lunar Cement". Scientific Reports 2019, 9 (2238). (Year: 2019) (Year: 2019).*

Steinberg, E. P. Development of lunar structural design criteria with emphasis on meteoroid effects, dissertation, University Microfilms International: Ann Arbor, MI, 1991. (Year: 1991).*

Wilhelm, S.; Curbach, M. Review of Possible Mineral Materials and Production Techniques for a Building Material on the Moon. Structural Concrete 2014, 15 (3), 419-128. (Year: 2014).*

Chen, T.-H. Developing Lunar "Cement" Using Lunar Soils. dissertation, ProQuest LLC: Ann Arbor, MI, 2015. (Year: 2015).*

Naser, M. Z.; Chehab, A. I. Materials and Design Concepts for Space-Resilient Structures. Progress in Aerospace Sciences 2018, 98, 74-90. (Year: 2018).*

Naser, M. Z. Extraterrestrial Construction Materials. Progress in Materials Science 2019, 105, 100577. (Year: 2019).*

Andrea E. Hoyt Haight, "Self-Healing Inflatable, Rigidizable Shelter for the Lunar Environment", NASA SBIR 2007 Solicitation.

B. Khoshnevis, et al., "Contour Crafting Simulation Plan for Lunar Settlement Infrastructure Build-Up", NIAC Phase 1 Final Project Report, Oct. 2012.

Eve Roth, "From Dust to Dome: Building a Lunar Habitat from 3-D Printers, an Inflatable Dome, and Soil From the Moon's Surface", Yale Scientific, Apr. 5, 2013.

Jan M. Gosau, "Lunar Regolith Excavation and Material Handling", NASA SBIR 2007 Solicitation.

Jan-Michael Gosau, "Load-Bearing Inflatables Using Light-Curing Rigidization Technology", NASA SBIR 2011 Solicitation.

Jan-Michael Gosau, et al., "Polyurethane Chemistry in Space", retrieved from https://www.adherent-tech.com/publications/download_document/89.

John Banhart, "Manufacturing Routes for Metallic Foams", JOM, Dec. 2000.

Morgan Saletta, et al., "Inflatable Modules Could be the Future of Space Habitats", retrieved May 10, 2019 from https://phys.org/news/2016-04-inflatable-modules-future-space-habitats.html.

* cited by examiner

100

METHOD FOR PRODUCING REGISHELL INFLATABLE ENVIRONMENT

FIELD

The present invention relates to inflatable environments, and more particularly, an inflatable environment that is constructed with partial In-Situ Resource Utilization (ISRU) of planetary surface soil (regolith) combined with polymer foam.

BACKGROUND

Inflatable environments attempt to establish different meteorological conditions (e.g. pressure, temperature, humidity, radiation, solar radiation, etc.) between two physical volumes of space. Most of these environments are used for habitats of some kind, but may also be volumes of space set up for other uses such as processing, manufacturing, etc. Inflatable environments provide a transportable and rapid method of installing a volume package utilizing gas expansion. There are many designs of terrestrial inflatable systems, but there are also designs applicable to space use. The most notable designs for human-rated inflatable modules are TransHab or Bigelow Aerospace's "BA330".

The term inflatable is also sometimes used to describe an airform, which is inflated to establish a formed structure, and then permanently rigidized by spraying a quick-hardening material (e.g. reaction polymers like polyurethanes) using a blowing agent (e.g. CO2/H2O). These are typically polyurethane foams with either closed cell (bubbles remain inside) or open cell (to allow air flow) properties. However, there is a desire for weight bearing materials, such as expandable foams, to be used on extraterrestrial bodies, such as the Moon, but where gravity differs from Earth (e.g. only ~0.17 g for the moon).

Current technology of sprayable foams for space applications is best highlighted by the foam used on the NASA® Space Shuttle, which protected and insulated the external fuel tank. A special blend of polyurethane materials was developed by NASA®. The foam does not require adhesives. Further this foam self-adheres to the surface of the tank with sufficient strength to withstand the forces of a launch, as well as the extreme temperatures of cryogenics and launch. NASA® used three types of foam for the 1" thick insulation (e.g., a polyurethane-BX-250 and two types of polyisocyanurates—NCFI 24-124 and NCFI 24-57). All three types were meant for thermal insulation and not for structural support.

There are other types of polyurethane blends that provide structural support under the rubric of geotechnical foams (e.g., NCFI "TerraThane" Polyurethanes). These spray foams have been used as substitute for backfill and void fills in stabilizing soil and concrete lifting. Depending on the application, the strength values, densities and reactivity profiles can be tailored.

Some polyurethane blends provide two desired properties (thermal insulation and waterproofing). For example, a product owned by Honeywell® (TerraStrong™) is used on army tents and provides combined protection for waterproofing, air and vapor control, thermal control and structural rigidity. Moreover, the underlying structural scaffold below the foam material can be removed and reused after the rigidization process is complete. Most of these materials have been designed for the meteorological variations found on Earth. Using the Moon as a non-Earth example, the harsh conditions prevailing on an inflatable environment, and more so if it is a human habitat, are severe temperature gradients (127 C→−173 C), hard vacuum (affecting building material outgassing), micrometeorite impingement (can hit the moon at speeds up to ~28 km/s), radiation (Sun and cosmic rays), solar wind (varies from $10^{10}$-$10^{12}$ particles per $cm^{-2}s^{-1}$ $sr^{-1}$) and lunar dust contamination.

Unlike on Earth where dust particles have been rounded as result of weathering, Lunar regolith is made up of fine yet abrasive shards capable of compromising plastics and fabrics. Inflatable environments for Earth applications and the polymeric materials used are designed to operate within a narrow variation of temperature, given the locality. The Earth's atmosphere moderates the weather and mitigates large temperature swings at a given locality. The moon, on the other hand, has no discernible atmosphere and has large temperature variations. Polymer properties have strong temperature dependences with density changes being the more prominent along with a low glass transition temperature.

Consequently, the design of an inflatable environment (or habitat) for extraterrestrial surfaces requires changes to the methodology from that of the assembly and materials used on Earth. Thus, an inflatable environment and construction methodology that maximizes ISRU, or use of local materials in the construction process, is the basis for the embodiments described herein.

SUMMARY

Certain embodiments of the present invention may provide solutions to the problems and needs in the art that have not yet been fully identified, appreciated, or solved by current inflatable environment design and construction methods. Some embodiments generally pertain to Regishell, which is composed of unique material. In certain embodiments, Regishell is made from a combination of polymer foam waste, solvent and locally-sourced soil (e.g., regolith), and is employed in several environments. In one example, Regishell is used in an inflatable environment (or habitat) to conform to the shape of an inflated outer airform on a lunar surface or underneath the ground in a lunar vault.

In an embodiment, the inflatable environment conforms to a dome shaped airform on a planetary surface and is reinforced with Regishell.

In another embodiment, the inflatable environment conforms to the walls of a lava tube or man-made cave under the planetary surface utilizing Regishell.

In yet another embodiment, the inflatable environment conforms to a pre-constructed scaffolding or deployed structure reinforced with Regishell.

In yet a further embodiment, Regishell is used to create bricks with a mold or 3D printing technique, or applied directly on the surface to create foundations, launchpads, roads or tracks.

BRIEF DESCRIPTION OF THE DRAWINGS

In order for the advantages of certain embodiments of the invention to be readily understood, a more particular description of the invention briefly described above will be rendered by reference to specific embodiments that are illustrated in the appended drawings. While it should be understood that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE EMBODIMENTS

Some embodiments of the Regishell inflatable environment generally pertain to a commercially-supplied and deployed dome inflatable airform. For purposes of explanation, an airform may be defined as air-inflated and air-supported forms used for enabling construction of permanent monolithic dome structures, where "air" could be any gaseous substance, in some embodiments. For additive rigidity, thermal control and radiation protection, an inflated airform layer is hardened on site using a construction method utilizing "Regishell". Regishell combines polymer foam in the form of beads, sheets, waste foam (as from equipment transport padding material), a solvent for melting the polymer, and local surface soil (e.g., regolith) materials.

In some embodiments, Regishell is applied to the interior (or inner layer) of the inflated airform to create the Regishell inflatable environment. Regishell is "sprayed" or applied as a "sandwich layer" to the inflated airform layer. When cured, a rigid structure is formed. The rigid structure may conform to the shape of the inflated external layer.

Figure 1:
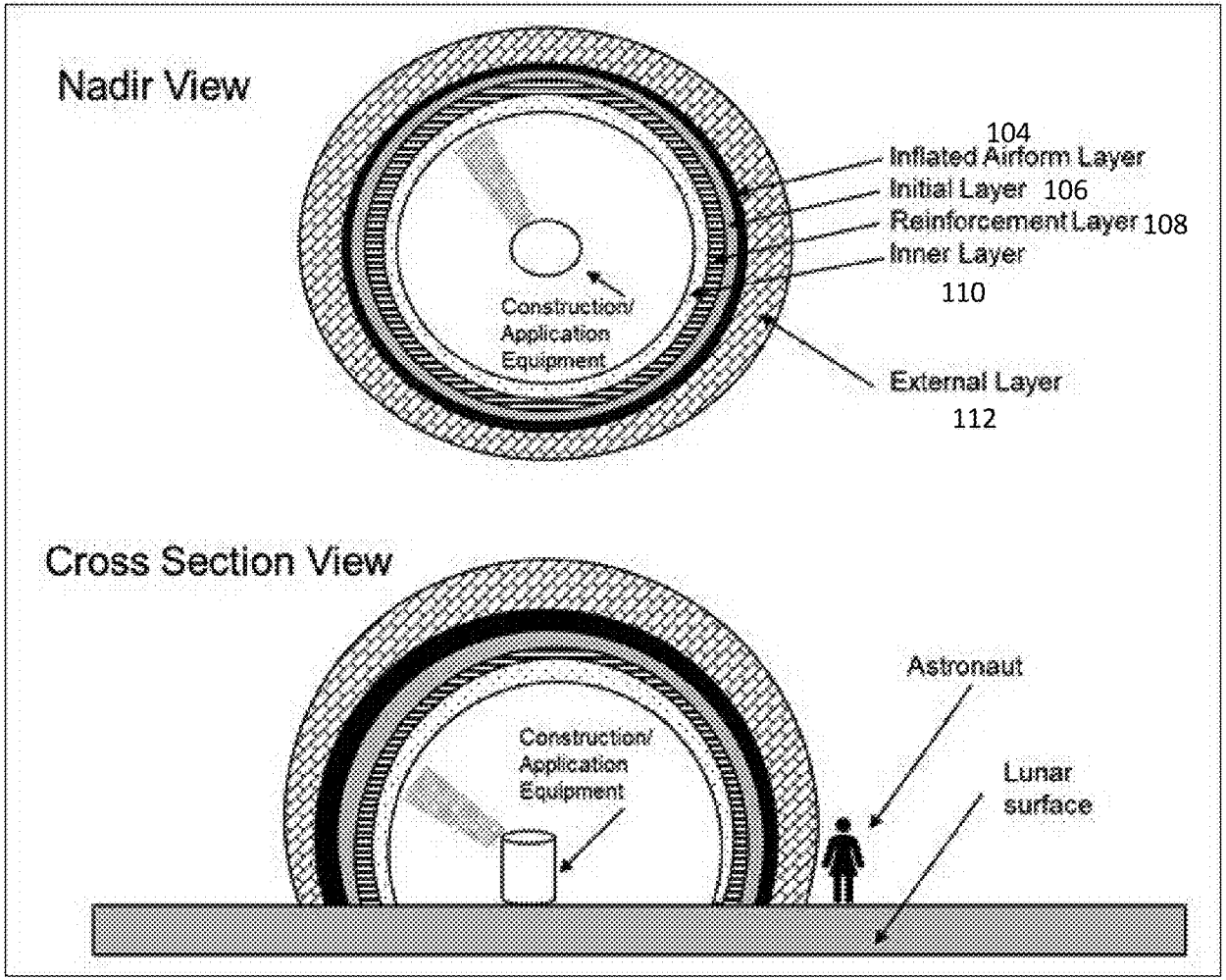
FIG. 1 is a diagram illustrating a Regishell inflatable environment, according to an embodiment of the present invention.

FIG. 1 is a diagram illustrating a nadir view and a cross-sectional view of a Regishell inflatable environment 100 on a lunar surface, according to an embodiment of the present invention. In some embodiments, Regishell inflatable environment 100 may be in the form of a dome structure and may be deployed on the surface 102 of a planet. In other embodiments, Regishell inflatable environment 100 may be deployed in a crater or lava tube underneath the surface of the planet. Regishell inflatable environment 100 may include a plurality of layers 104-112.

Below is a description of the layers within Regishell inflatable environment 100. For example, an inflatable airform layer 104 may be defined as material of an inflated airform, and may act as a base layer to separate the internal and external environments of Regishell inflatable environment 100. An initial layer 106 may be composed of Regishell (e.g., polymer and regolith), and may be applied to the inside of inflated airform layer 104 to stabilize Regishell inflatable environment 100. A reinforcement layer 108 is also used to strengthen Regishell inflatable environment 100, and may be composed of a combination of in-situ basalt fibers, which are created from sintered regolith, and Regishell. Inner layer 110 may be similar to that of initial layer 106. However, inner layer 110, which is composed of Regishell (e.g., polymer+regolith), is applied to the inside of reinforcement layer 108. External layer 112 is also composed of Regishell (e.g., polymer+regolith). It should be noted that additional additives for radiation protection may be applied to the outside of Regishell inflatable environment 100, in certain embodiments. Moreover, the ratio of polymer to regolith in the mixture between the external later 112 and inner layer 110 could be different.

It should be appreciated that Regishell is created when polymer is mixed with lunar regolith. Regishell may be applied to the interior of Regishell inflatable environment 100, i.e., applied to initial layer 106, allowing the interior of Regishell inflatable environment 100 to harden. As shown in FIG. 1, Regishell may be applied as a "spray", or applied as a "sandwich" to the airform by pumping the material into a pre-constructed membrane on the inflated airform layer 104. Regishell can also be applied to the inside of reinforcement layer 108 as inner layer 110, and applied to external layer 112. The creation of these layers does not require sintering or casting of the regolith, but they do require curing. The time to cure is on the order of hours and may depend on the polymer to the regolith ratio, as these materials have different thermal conductivities. In embodiments that expose the Regishell to vacuum, the time to cool is longer than on Earth due to a lack of air convection, however the time to remove trapped gases (a form of curing) will be shorter as a result of the vacuum pressure.

Reinforcement layer 108 may require a composite material made with basalt fiber extracted from the Lunar regolith and combined with the Regishell. This provides high strength reinforcement to one or more layers of Regishell inflatable environment 100.

When lunar regolith is preprocessed (mineral extraction), heated and cooled the lunar regolith produces basalt fibers needed for reinforcement layer 108. When controllably heated and cooled, gases and basalt glass composite material may be extracted from the lunar regolith. In some embodiments, basalt glass composite material combines three silicate minerals, i.e., plagioclase, pyroxene and olivine. Prior to cooling the basalt glass can then be further processed to form larger/longer fibers and then mixed with polymer-based Regishell, akin to glass and fiber composites on Earth.

Basalt is readily available on the moon but in 100-micron size particles. There is a technology developed on earth for fabricating basalt fibers (which have better physiochemical properties than fiberglass) and it is a one-stage process that includes crushing and melting (1500° C.), homogenization of basalt and extraction of fibers (via extrusion through small nozzles). The basalt is only heated once. These fibers can then be wound (fiber bundles) and then "woven" (if necessary). It should be appreciated that the above processes can be implemented via robotic action. The fibers or bundles of woven segments can then be mixed into the polyurethane materials for added strength and then applied to the apparatus as described above.

Figure 2:
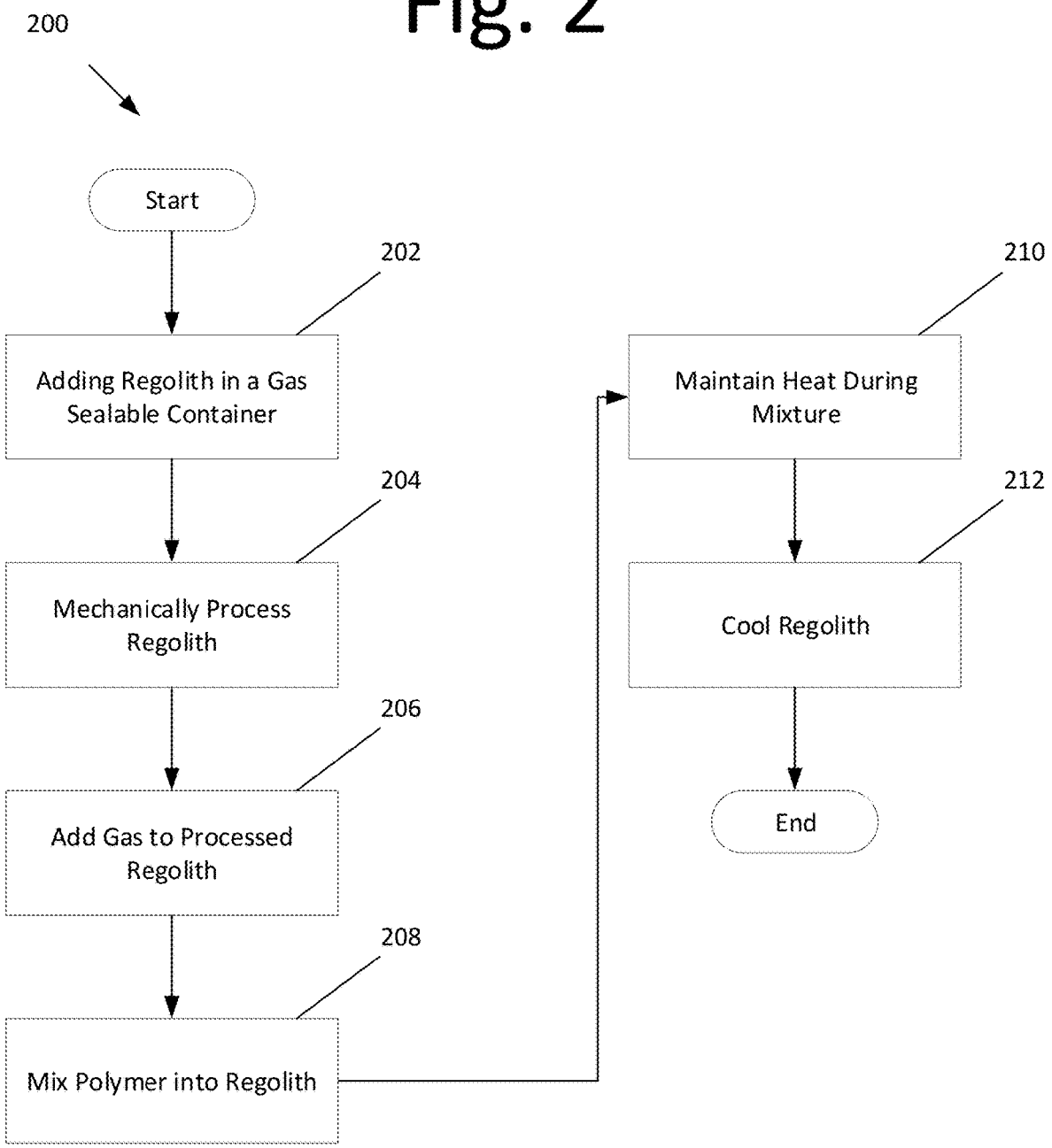
FIG. 2 is a flow diagram illustrating a process for manufacturing Regishell, according to an embodiment of the present invention.

FIG. 2 is a flow diagram illustrating a process 200 for manufacturing the Regishell, according to an embodiment of the present invention. In some embodiments, Regishell comprises polymer material brought from Earth (initially) and regolith material taken from the Moon. In some further embodiments, polymer solvent is brought from Earth (initially) or prepared on the Moon using a chemical plant. FIG. 2 shows a process for producing Regishell with and without heat.

An example of a solvent is acetone, which reduces polymers like polystyrene (e.g., extruded polystyrene foam, similar to packing beads) into a slimy material. This slimy material can then be mixed with regolith without added heat.

Other organic solvents may also work in some embodiments. Alternatively, heat may be used to melt the polymer foam material to enable mixing. FIG. 2, as discussed in more detail below, suggests the material preparation provides at least two deployment schemes. If the deployment scheme is to be applied by a spray, then a compressible gas must be mixed into the mixture. In all cases, however, the applied material should be deposited in thin layers to allow gases to escape and for the material to cool or harden. On Earth, this polystyrene "slime" has a much slower cure rate, so it takes on the order of hours to harden. The rate is dependent on removing the trapped volatile compounds.

In some embodiments, process 200 may begin at 202 with adding Regolith in a gas sealable container. At 204, the Regolith is mechanically processed to minimize shard edges. For purposes of explanation, mechanically processed may be defined as the use of two mechanical surfaces that act to grind, break apart and shape the Regolith to enhance its use as a filler material for the polymer material, which acts as a matrix.

At 206, gas may be added to the processed Regolith at sub-Earth atmosphere pressure. Any type of gas could be used because it serves as a transfer vehicle for the mixture. A reactive gas (one that chemically reacts with the polymer or Regolith) could also be used but an inert gas would be the more preferred. In practicality, one should use gases that could be "mined" or extracted from the Regolith. For example, for lunar Regolith and using the data from the Apollo missions, upon heating, gases are dissipated along the following ratios, carbon is released mainly in the form of CO and CO2 (300-400 ppm) while nitrogen is released as N2 or NH3 (150-250 ppm). Sulfur is also released as SO2 and H2S (20-1300 ppm). If the habitat is for human environment, then the release of sulfur-based gas compounds should be minimized (toxic). Fortunately, these compounds are volatilized when the temperature is close to 1000 C. The nitrogen and carbon-based compounds come off at much lower temperatures. Consequently, there is a preprocess of excavating Regolith and distilling the gases to be used. However, it is also possible to bring inert gases from Earth (e.g. argon, nitrogen), and in certain embodiments, where there is an inflatable layer that forms the shape, it is possible to conceive of a robot that uses part of the gas within the inflated "balloon" as a high pressure propellant for dispensing material. In an alternative embodiment, heat may be applied on the processed Regolith to release gases. Depending on the embodiment, the heat applied is from heat focused sun radiation or from an electrical source. If the heat source is focused sun radiation, then it requires a curved shaped mirror (e.g. 1-2 m) that focusses the sun radiation into/onto the processed Regolith to heat it. The focused radiation would be on the "pipe" that contains the material. On the moon there is approximately 1.3 $kW/m^2$ of solar power. A simple calculation can be done to show the power requirements. If a pipe of some length had an inner diameter such that the inner volume is 8 cubic inches, and assuming sandstone material on the inside and at a temperature of 20 C. Only 632 W of thermal energy would be needed and that for only 2 minutes to raise the sandstone temperature from 20 C to 300 C (well above the polymer melting temperatures). Consequently, a 1 m dia. solar concentrator operating at 50% efficiency could raise the temperature to levels necessary for the process described in FIG. 2. In embodiments that use an electrical source for heating the material, a person of ordinary skill in the art may envision a number of electrical sources that power the resistive electrical heaters mounted alongside the pipe. For example, one may use nuclear radioisotope thermoelectric generator (e.g. NASA's MMRTG) or a solar cell array that generates the necessary power, to name a few.

At 208, polymer is mixed into the regolith to form a binder. The mixing may be performed at a predetermined temperature sufficient for viscous fluid flow of the polymer. The polymer to regolith ratio may depend on the properties of the polymer. The key property is the viscosity of the polymer at the applied temperature. Less viscous material enables quicker mixing with the Regolith. At a given temperature, lower viscosity polymers tend to have lower molecular weight. Other relevant properties are to decrease the modulus (i.e., the slope of the stress-strain curve at zero strain), which happens with increasing temperature. In an embodiment, the "melt index" (a test established by the polymer thermoforming community as a quick test of flowability) can be used as a guide when a higher melt index number is needed. Other pertinent properties include, for example, heat capacity (amount of energy required to elevate polymer temperature) and less of an issue is the thermal conductivity (measure of energy transmission through the material). It should be noted that if heat was not applied in the previous step, then the polymer may be more of a solvent such as an acetone.

At 210, heat is maintained during application of the mixture to insure the composite material flows through the dispensing tool and only hardens when in contact with the desired build surface. The material should be dispensed at a rate that insures the removal of trapped gases prior to cooling/hardening. In some embodiments, if the regolith is going to be applied via a spray approach, compressible gas (e.g., $CO_2$) is added to the Regishell. The compressible gas is a propellant that pushes the product out in the open and to the build location via free space air transfer. If the tool is operating as a direct-write build tool (layer by layer construction using a close-to-contact dispenser), then compressed gas may not be necessary. At 212, the regolith is cooled prior to applying a second layer. This process step is only valid if the construction is via layer-by-layer direct-write mode dispensing. The material is allowed to cool between layers to primarily remove trapped gases. It does not have to be cooled to the ambient temperatures, but just low enough that all trapped gases leave (only if gases were mixed into the Regishell).

Regishell Deployment

Depending on the embodiment, Regishell can be deployed numerous ways. For example, Regishell may be sprayed onto an airform or Regishell may be piped into a "sandwich" membrane layer of the airform. In another embodiment, Regishell may be directly applied to a lunar rock or surface (that will attach) or may be prepared as Regishell "bricks", which are attached to a scaffold that has been deployed.

Spraying the Regishell

Figure 3:
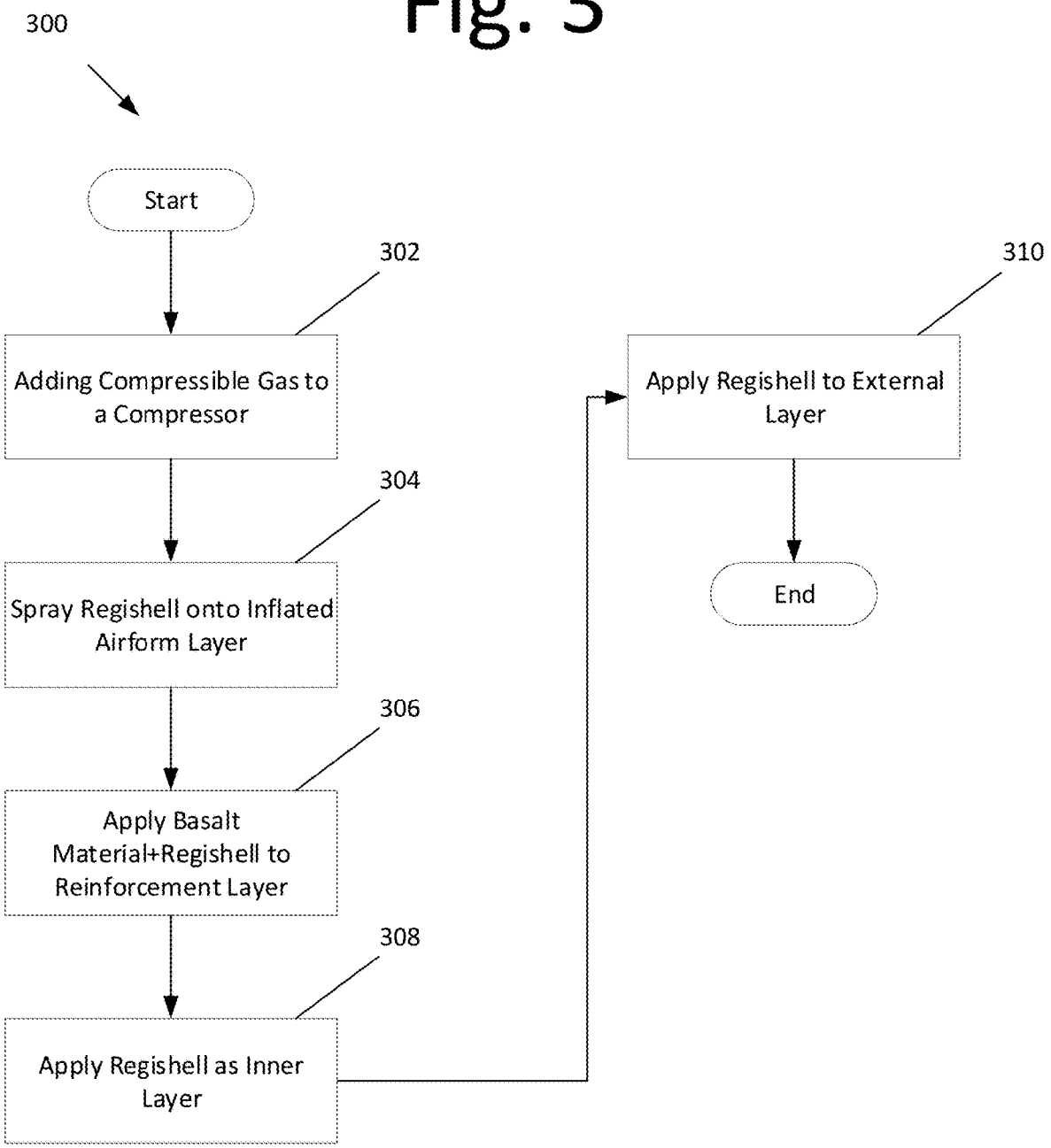
FIG. 3 is a flow diagram illustrating a process for spraying the Regishell onto an airform, according to an embodiment of the present invention.

FIG. 3 is a flow diagram illustrating a process 300 for spraying the Regishell onto an airform, according to an embodiment of the present invention. In this embodiment, the Regishell applied at high speed directly onto the inflated airform layer by "spraying", where it cures and hardens to form a structurally sound layer. See, for example, FIG. 1.

In some embodiments, process 300 may begin at 302 with adding compressible gas (e.g., $CO_2$) to the compressor that contains the Regishell. At 304, using the compressor, the Regishell is sprayed onto the inflated airform layer at a high throughput force to form the initial layer. At 306, basalt material created for reinforcement is combined with the Regishell, so the combination may be applied to the reinforcement layer. At 308, additional Regishell is applied to the reinforcement layer as the inner layer, and at 310, additional Regishell (with protective additives) is applied to the external layer.

Figure 4:
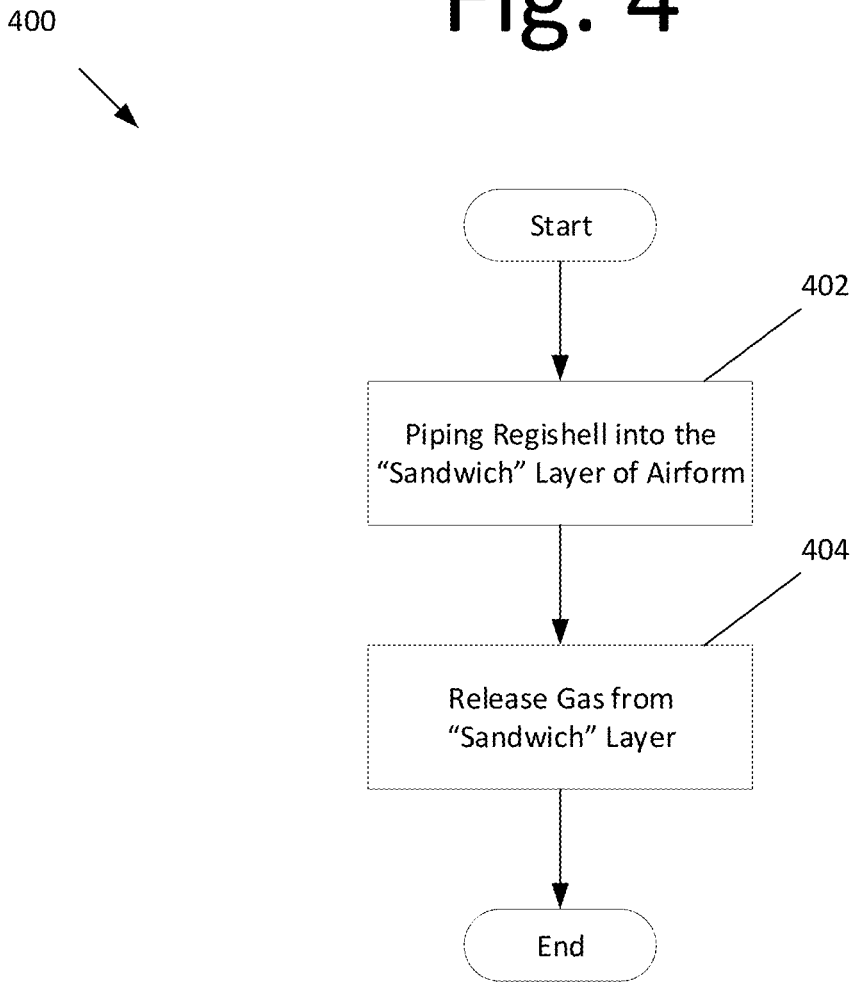
FIG. 4 is a flow diagram illustrating a process for piping the Regishell into a "sandwich" membrane layer of the inflated airform layer, according to an embodiment of the present invention.

FIG. 4 is a flow diagram illustrating a process 400 for piping the Regishell into a "sandwich" membrane layer of the inflated airform layer, according to an embodiment of the present invention. In this embodiment, the process begins at 402 with piping the Regishell into a middle-trapped layer "sandwiched" between the inflated airform layer and a membrane. At 404, once the Regishell is piped in, the Regishell cures and conforms as a rigid shape and structurally sound layer by way of releasing gas from the sandwich membrane by way of vents.

Figure 5:
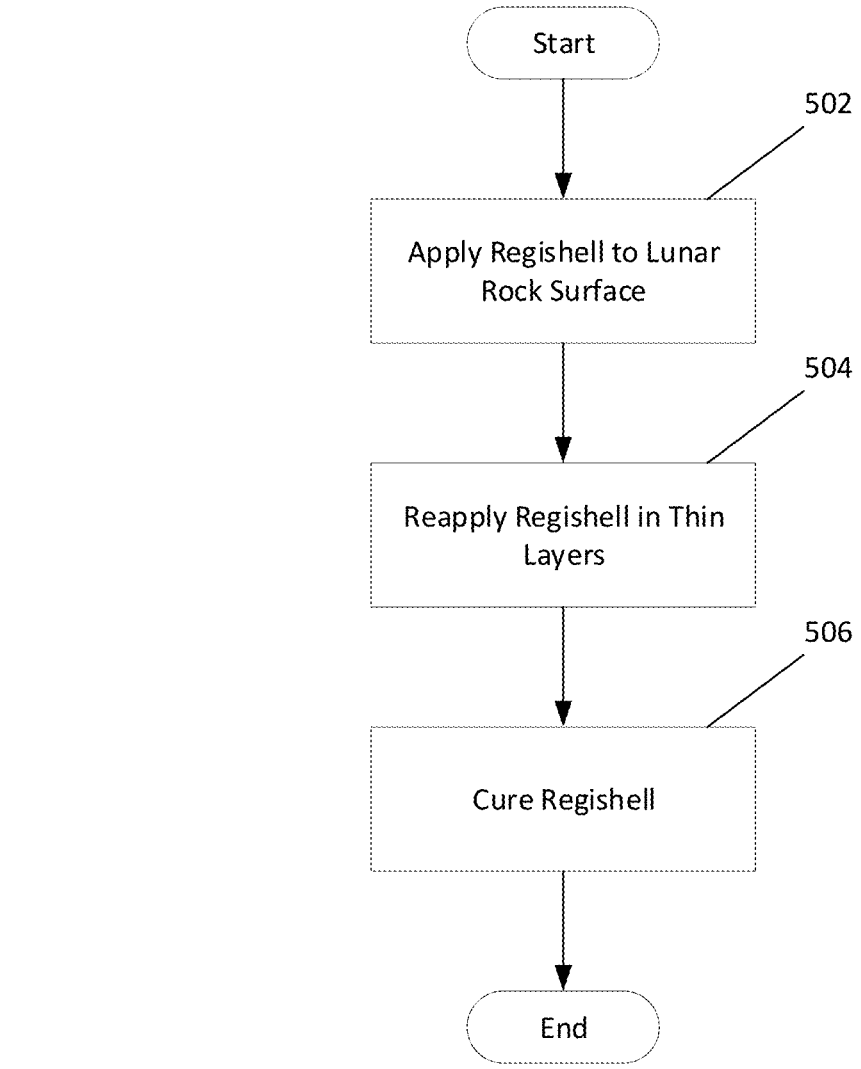
FIG. 5 is a flow diagram illustrating a process for directly applying the Regishell to a lunar rock or surface, according to an embodiment of the present invention.

FIG. 5 is a flow diagram illustrating a process 500 for directly applying the Regishell to a lunar rock or surface, according to an embodiment of the present invention. In this embodiment, the Regishell is intended to be applied to lunar rock surface, layer-by-layer. In some embodiments, this process creates a foundation for the inflatable environment. Process 500 may begin at 502 with applying the Regishell directly on a lunar rock surface. At 504, the Regishell is reapplied in a thin layer onto the lunar rock surface, and at 506, the Regishell is then cured so that process 500 can be started over again.

Figure 6:
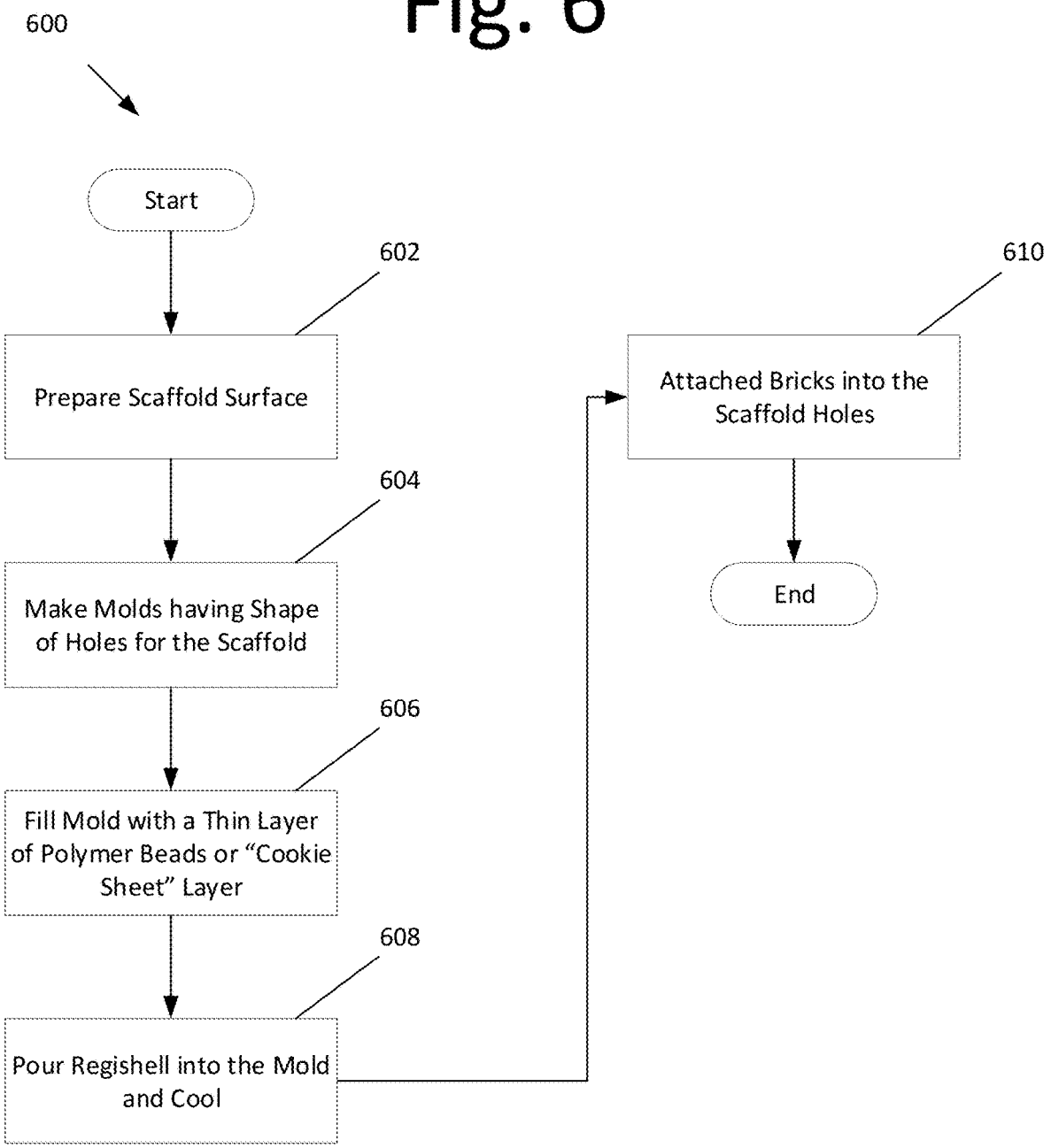
FIG. 6 is a flow diagram illustrating a process for the preparation of Regishell "bricks", according to an embodiment of the present invention

FIG. 6 is a flow diagram illustrating a process 600 for the preparation of Regishell "bricks", which will be attached to a scaffold that has been deployed, according to an embodiment of the present invention. In this embodiment, molded shapes are developed using the Regishell in order to form a large amount of strongly viscous Regishell that can be used as building material by additive manufacturing techniques.

Process 600 may begin at 602 with preparing a scaffold surface, and at 604, making a mold that have the shape of holes for the scaffold. At 606, the mold is filled with a thin layer of either polymer beads or polymer "cookie sheet" layer. This may be considered as a sacrificial layer.

At 608, the Regishell is poured into the mold and allowed to cool so it can take shape of the mold. At 610, the mold is heated to locally melt the sacrificial layer to release the molded shape, and at 612, a pick-and-place robot is used to attached shaped "brick" into the scaffold holes. The use of the molded bricks also works for developing "roads" for wheeled robots. The brick-roads limit the generation of dust.

These embodiments and processes may be accomplished by robotic payloads delivered to the lunar surface ahead of human habitation. The robotic payloads may create initial infrastructure for astronaut crew sorties of short length. Once there is an interest in continuous and sustained presence on the planetary surface, robotic payloads could prepare a suitable surface to act as a foundation for deploying the Regishell inflatable environment.

A robotic precursor mission could also produce the basalt fibers needed for the reinforcement layer of the Regishell inflatable environments. A robotic precursor mission could deploy, assemble, and create material for the entire Regishell inflatable environment by robotic means, in preparation for crew to arrive.

Since the Regishell is a mixture of ISRU material and a polymer binder, one of ordinary skill in the art could imagine surfaces prepared using these special mixtures that will soften during daytime and harden at nighttime. Polystyrene for example will not melt at solar surface temperatures, but other polymers can be tailored to soften at solar surface temperatures. An additional embodiment of this concept is bricked roads that during the day would allow a leading mobile wheeled vehicle to generate a small depression (e.g. 1-2") which then becomes a guide "track" for automated vehicles that follow it.

It will be readily understood that the components of various embodiments of the present invention, as generally described and illustrated in the figures herein, may be arranged and designed in a wide variety of different configurations. Thus, the detailed description of the embodiments, as represented in the attached figures, is not intended to limit the scope of the invention as claimed, but is merely representative of selected embodiments of the invention.

The features, structures, or characteristics of the invention described throughout this specification may be combined in any suitable manner in one or more embodiments. For example, reference throughout this specification to "certain embodiments," "some embodiments," or similar language means that a particular feature, structure, or characteristic described in connection with the embodiment is included in at least one embodiment of the present invention. Thus, appearances of the phrases "in certain embodiments," "in some embodiment," "in other embodiments," or similar language throughout this specification do not necessarily all refer to the same group of embodiments and the described features, structures, or characteristics may be combined in any suitable manner in one or more embodiments.

It should be noted that reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

One having ordinary skill in the art will readily understand that the invention as discussed above may be practiced with steps in a different order, and/or with hardware elements in configurations which are different than those which are disclosed. Therefore, although the invention has been described based upon these preferred embodiments, it would be apparent to those of skill in the art that certain modifications, variations, and alternative constructions would be apparent, while remaining within the spirit and scope of the invention. In order to determine the metes and bounds of the invention, therefore, reference should be made to the appended claims.

The invention claimed is:

1. A method for constructing an inflatable environment on top of or beneath a surface of an extraterrestrial object, comprising:

spraying Regishell onto an airform or piping the Regishell into a sandwich layer of the airform, the sandwich layer is a middle-trapped layer sandwiched between the airform and a membrane, wherein wherein when performing the spraying of the Regishell, the method further comprises combining basalt material with the Regishell and applying the combination of the basalt material and Regishell to a reinforcement layer, the reinforcement layer being internal to the airform to strengthen the inflatable environment;

wherein when performing the piping of the Regishell into the sandwich layer, the sandwich layer membrane comprises vents and, the method further comprises releasing gas from the Regishell by way of the vents to cure and conform the Regishell as a rigid shape and structurally sound layer, and wherein Regishell is composed of a binder material and regolith.

2. The method of claim 1, wherein the airform is an air-inflated and air-supported form enabling construction of permanent monolithic dome structures.

3. The method of claim 1, wherein the Regishell is processed with heat to release gas.

4. The method of claim 3, wherein the heat is from focused sun radiation or from an electrical source.

5. The method of claim 1, wherein the constructing of the inflatable environment is performed with partial in-situ resource utilization of the Regolith to create the binder material.

* * * * *